US011266003B2

(12) United States Patent
Mujahid et al.

(10) Patent No.: US 11,266,003 B2
(45) Date of Patent: Mar. 1, 2022

(54) METHOD AND APPARATUS FOR GENERATING PLASMA USING A PATTERNED DIELECTRIC OR ELECTRODE

(71) Applicants: Zaka-Ul-Islam Mujahid, Jazan (SA); Mohammed D Oteef, Jazan (SA)

(72) Inventors: Zaka-Ul-Islam Mujahid, Jazan (SA); Mohammed D Oteef, Jazan (SA)

( * ) Notice: Subject to any disclaimer, the term of this patent is extended or adjusted under 35 U.S.C. 154(b) by 0 days.

(21) Appl. No.: 16/007,959

(22) Filed: Jun. 13, 2018

(65) Prior Publication Data

US 2021/0235573 A1 Jul. 29, 2021

Related U.S. Application Data

(60) Provisional application No. 62/518,622, filed on Jun. 13, 2017.

(51) Int. Cl.
*H05H 1/24* (2006.01)

(52) U.S. Cl.
CPC ..... *H05H 1/2406* (2013.01)

(58) Field of Classification Search
CPC ..... H05H 1/24; H05H 1/2406; H05H 1/2418; H05H 1/2425; H05H 1/2441
See application file for complete search history.

(56) References Cited

U.S. PATENT DOCUMENTS 5,686,789 A * 11/1997 Schoenbach ..... H01J 1/025 313/491
5,820,947 A * 10/1998 Itoh ..... H01J 37/32082 427/577
8,252,669 B2 * 8/2012 Toriumi ..... H01J 37/3244 438/488
2003/0132100 A1 * 7/2003 Crowe ..... A61L 2/14 204/164
2009/0102385 A1 * 4/2009 Wi ..... H01J 37/32091 315/111.21
2011/0162802 A1 * 7/2011 Okumura ..... H01J 37/32541 156/345.44
2012/0193456 A1 * 8/2012 Lubomirsky ..... H01J 37/32091 239/548
2012/0229029 A1 * 9/2012 Takenoshita ..... H05H 1/2406 315/111.21
2012/0313556 A1 * 12/2012 Heid ..... H05H 5/06 315/506
2013/0284588 A1 * 10/2013 Malik ..... H05H 1/2406 204/164
2014/0138030 A1 * 5/2014 Sawada ..... H01J 37/32559 156/345.29
2015/0137677 A1 * 5/2015 Sohn ..... A61L 2/14 313/268
(Continued)

*Primary Examiner* — Jason Crawford

(57) ABSTRACT

Exemplary devices and methods for generating plasma are provided, which may include a first electrode component with a first side portion and a second side portion, a second electrode component having a proximate front side portion and a proximate back side portion, a plasma producing region, a ground connector component into engagement with the second electrode component, a first dielectric segment for coating the second side portion of said first electrode component. An electric power receiver into engagement with the first electrode component, wherein the electric power, when applied, converts gas disposed in the plasma producing region, into plasma.

20 Claims, 12 Drawing Sheets

(56) References Cited

U.S. PATENT DOCUMENTS

| | | | | |
|---|---|---|---|---|
| 2015/0294877 | A1* | 10/2015 | Kitano | H05H 1/2406<br>438/475 |
| 2015/0340204 | A1* | 11/2015 | Kudela | H01J 37/3222<br>315/39 |
| 2016/0233059 | A1* | 8/2016 | Hensley | H01J 37/32532 |
| 2021/0235573 | A1* | 7/2021 | Mujahid | H05H 1/2441 |

* cited by examiner

METHOD AND APPARATUS FOR GENERATING PLASMA USING A PATTERNED DIELECTRIC OR ELECTRODE

CROSS-REFERENCE TO RELATED APPLICATIONS

The present Utility patent application claims priority benefit of the U.S. provisional application for patent Ser. No. 62/518,622 entitled "A plasma device with patterned dielectric", filed on 13 Jun. 2017, under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

The following related U.S. patent application(s), submitted by at least one of the present Applicant(s)/Inventor(s) is/(are) recently co-pending: U.S. utility patent application Ser. No. 15/907,956 entitled "A Plasma Treatment Method and System for Plants", submitted to the United States Patent and Trademark Office (USPTO) on 28 Feb. 2018.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to a plasma device with patterned dielectric. More particularly, certain embodiments of the invention relates to a plasma device with patterned dielectric barrier between the electrodes.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, an aspect of the prior art generally useful to be aware of is that non-thermal plasma (NTP) technology has commonly attracted interest of scientists recently for removal of gaseous pollutants. Currently companies may successfully remove various gaseous pollutants, mostly at ambient temperatures. This may be relatively new compared to other conventional pollution control techniques. Multiple kinds of discharges have commonly gained interest for application in this area, yet most of the attention is typically towards a kind of dielectric barrier discharge (DBD), called packed bed plasma reactor (PBPR). A so-called dielectric barrier discharge (DBD) may be a kind of atmospheric pressure plasma where a dielectric coating/covering is present on one or both electrodes. Geometrically electrodes may be arranged as two parallel flat or curved plates or two concentric cylinders, separated by a gap of a few mm through which a gas may be flown. When an electrical power may be applied to electrodes, a gas may be converted to plasma. A gap between a DBD may be filled with catalyst pellets. This arrangement may be known as a so-called packed bed plasma reactor (PBPR), or an application may be called a plasma catalysis. In this case, a plasma forms in small voids between pellets and pellet-walls. As polluted air may flow in through one end of a PBPR, toxic molecules such as VOCs may be destroyed at another end. There may be several challenges to commercializing the process. A scale-up reactor usually loses said advantages of a PBPR and generating large area uniform discharge may not be easy. Furthermore, reported systems commonly do not qualify the durability of commercial systems. Furthermore still, current solutions typically leave no energy efficient design to address these challenges.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1A:
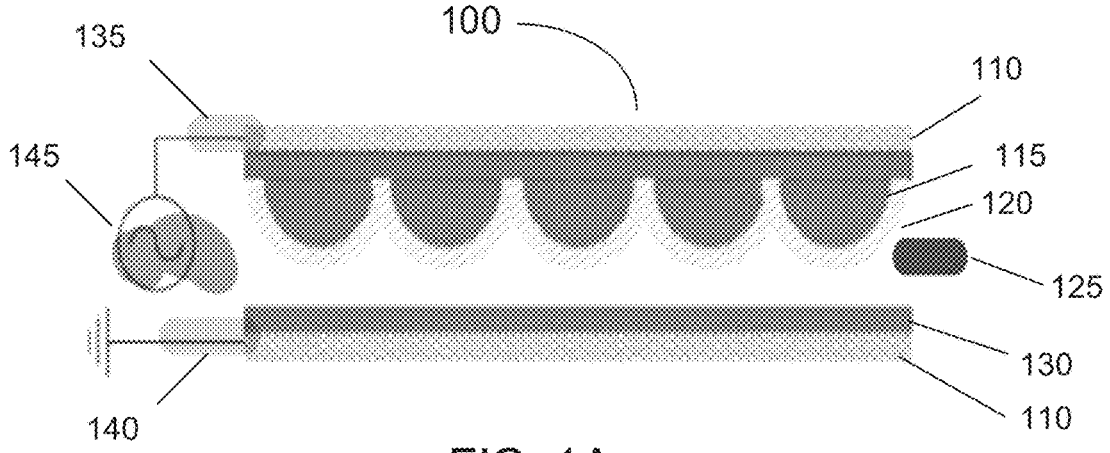
FIG. 1A illustrates the 2D schematic diagram of an exemplary complete plasma system containing one non-uniform spherical/circular shaped corrugated/extruded dielectric surface, coated with the catalyst, and one plane dielectric surface in accordance with an embodiment of the invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003) Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit —"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter", see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An exemplary embodiment of the present invention may provide an improved plasma device to generate a relatively uniform, stable and reproducible discharge over large areas which may operate at approximately 5-60% lower power than a conventional dielectric barrier discharge (DBD). The invention may use a patterned dielectric 410 as shown in FIG. 1 and FIG. 4A through FIG. 4I, either over one or both electrodes 405 and/or between two electrodes which may produce several small plasmas at regular positions. Plasma may either be generated at a location of a shortest distance or surface or contact points (i.e. between the dielectric structures) or any of the two sites or all sites. This design may produce low-temperature (approximately 20-500° C.) plasma with higher plasma generated reactive radical species (e.g. O, OH, N, NO, etc.) production than a single plasma of a similar size. In an exemplary embodiment this may be applied to activities including but not limited to gaseous/aerosol pollutant removal, gas conversion, sterilization of articles, surface treatment, surface functionalization, sterilization of air, ozone production, generating nanoparticles, charging particles and their removal, hydrocarbon conversion and oil cracking.

Figure 2:
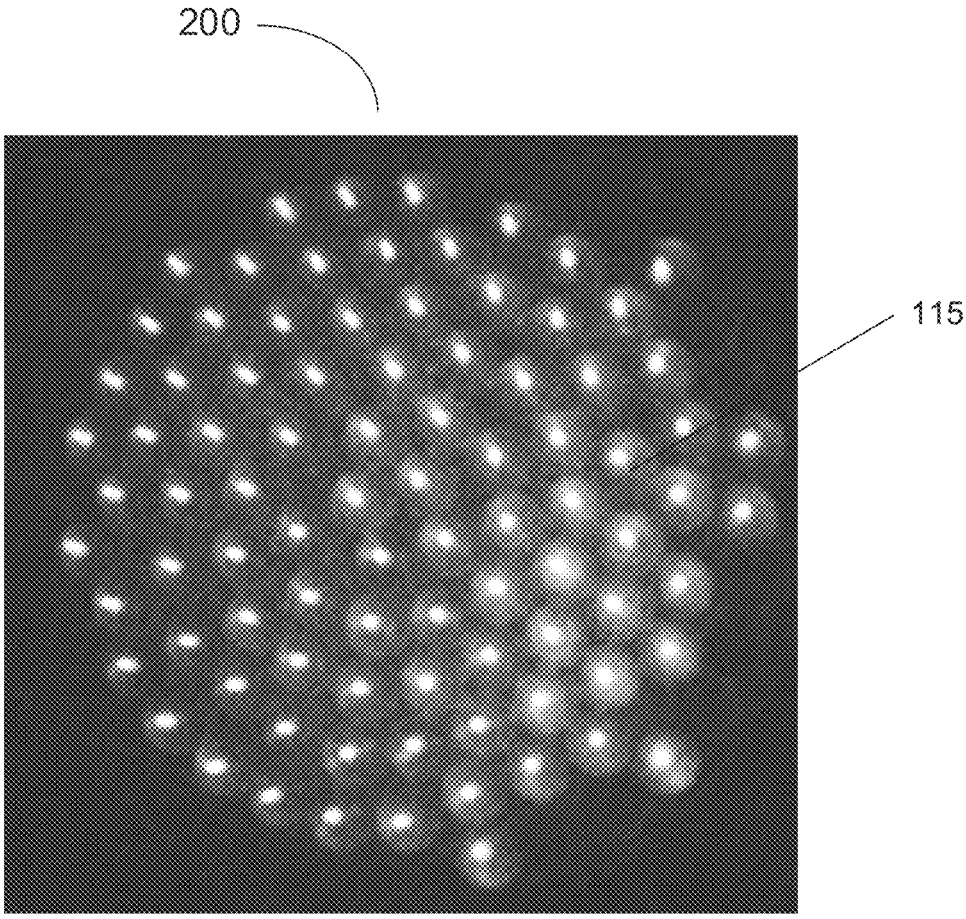
FIG. 2 illustrates a position of an exemplary production of plasma at low power, in accordance with an embodiment of the invention.
Figure 3:
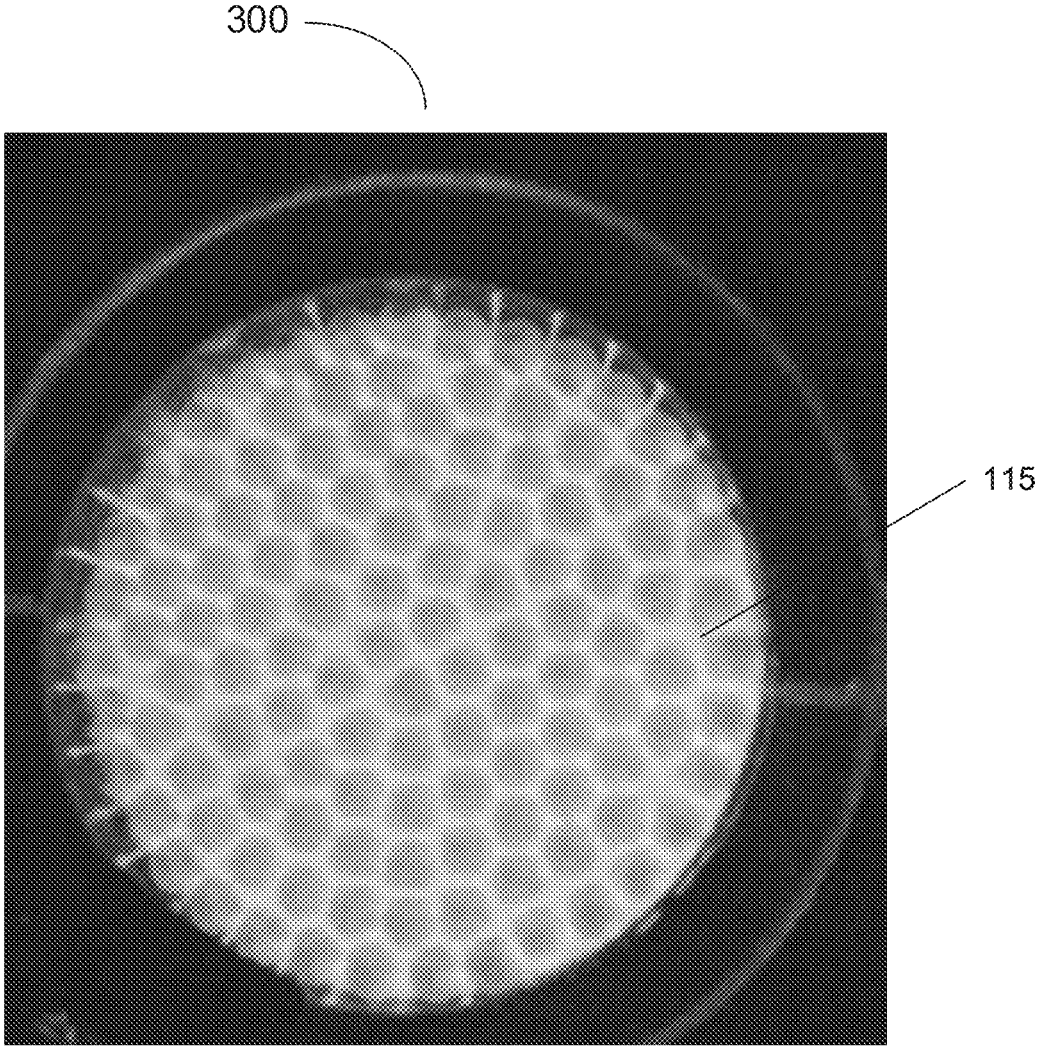
FIG. 3 illustrates a position of an exemplary production of plasma at high power, in accordance with an embodiment of the invention.

In an exemplary embodiment this invention may provide a dielectric barrier plasma (DBD: Dielectric Barrier Discharge) comprising of at least two electrodes 405 as shown in FIG. 1 and FIG. 4A through FIG. 4I where one or more non-uniform dielectric 410 may be present inside a plasma production region. A non-uniform dielectric 410 may be either roughened or structured irregularly or contains regular grooves or patterns as shown in FIG. 1B, FIG. 1C, FIGS. 6 and 510 in FIG. 5. A plasma device may consist of two electrodes 405 as shown in FIG. 1 and FIG. 4A through FIG. 4I spaced apart, powered by a DC, or AC, or kHz, or pulsed, or RF voltage applied to the electrodes, and a dielectric 410 with non-uniform surface between the two electrodes. Electrodes may be arranged either a parallel flat plate configuration as in FIG. 1A and FIG. 4A through FIG. 4D, FIG. 4G FIG. 4H or as a parallel curved plate or a coaxial arrangement of two cylinders as in FIG. 4F where electrodes 405 may be separated by a certain distance (approximately 0.1-50 mm). In all cases a distance between two electrodes 405 may be preferably constant at all locations. Each electrode may also be attached directly on one of two sides of a dielectric (approximate thickness 0.002-20 mm), relatively similar to typical surface barrier discharge as in FIG. 4E. Electrodes behind a dielectric plate may be a solid or mesh type as in FIG. 4E and FIG. 4I. Solid electrodes may be smooth, roughened, grooved or patterned as in FIG. 4D. One or both of the electrodes may be coated on the side exposed to plasma as in FIG. 4D with dielectrics made of a material including but not limited to ceramic (alumina, zirconia, silica, zeolites, BaTiO3 etc.), or glass, or catalyst (metal nanoparticles, metal oxide etc.), or photocatalyst (TiO2), or their combination. Dielectrics may be in a form of flat plates, curved plates, cylinders, or with non-uniform surface, which covers electrode partially or entirely. Dielectrics may preferably be in one piece but may also be in several pieces or tiles to generate a geometry or shape. Several exemplary dielectric parts may be held freely, or held together mechanically, or connected by thread or glued together, or glued to the electrode. Dielectric covering of one or both electrodes may be either roughened or patterned randomly or patterned regularly. A surface of a dielectric plate with a regular pattern may consist comprise of but not limited to multiple extruded, grooved, corrugated, fluted or ribbed shapes including but not limited to spheres (circular), hemispheres, lenses, cones, oval, pyramids, saw tooth, squares, rectangles etc., as in FIG. 1A through FIG. 1C, FIG. 5 and FIG. 6 etc. An exemplary dielectric may also have extruded or grooved or both structures in linear or curved shape as in FIG. 1B. An exemplary shape of structure grooved, corrugated, fluted, ribbed or extruded may be hemisphere, or lens, or triangular, or square etc. as in FIG. 1C. Exemplary dielectric may also be patterned by grooves with linear electrodes. A dielectric may be entirely or partially covered by a catalyst and/or photo-catalyst as in FIG. 1A. In summary, a dielectric may have several structures, corrugation, channels, flutes, ribs, or grooves on a surface exposed to plasma which may be curved perpendicular or parallel to electrodes or electric field, as in FIG. 1B, FIG. 1C, FIG. 5 and FIG. 6 field. An exemplary plasma system may operate at a gas pressure of approximately $10^{-3}$ Torr to 10000 Torr, or in air, or any other gasses. A plasma apparatus discussed here may generate several small stable plasmas. An exemplary plasma apparatus may be scaled up or down to a larger or smaller size ($m^2$-$mm^2$) without losing or changing performance parameters significantly, in a broad range of configurations. An effective surface area of a dielectric on a side exposed to plasma may be relatively 1-20 times more than a flat dielectric plate with relatively similar area approximately. Furthermore, a discharge may be relatively stable. At a low power, it may generate multiple small discharges, which may use relatively little power (approximately 1-100 $mW/cm^2$) and produce very low gas temperatures (approximately 20-100° C.), as in FIG. 2C). Discharges may be generated as filaments at a location of a smallest electrode distance, as in FIG. 2 distance. Plasma may be relatively suitable for an operation in conditions where low ozone generation may be desired. At high power, again multiple small discharges may be generated, similar to a regular packed bed DBD. It may generate discharges in a location of a minimum distance between electrodes as filaments, small discharges at contact points (where two dielectric structures meet) and over curved surface of a dielectric, as in FIG. 3 dielectric. Plasma may be very suitable for an operation in conditions where high ozone and radical generation may be desired, and where very low temperature may not be a major requirement (approximately 20-100° C.). An intense plasma may be generated at contact points, as in FIG. 3 points. Regularly patterned dielectric surface may generate several stable small plasmas over a large area, as in FIG. 2 and FIG. 3 area. A DBD system may have parallel plate (with flat or curved plates) as in FIG. 1 or coaxial arrangement as in FIG. 4F.

Due to a generation of a vast number of small plasmas, a higher amount of ozone and radicals may be produced than production of single plasma, at comparable powers. An exemplary plasma apparatus design usability may also be understood that it uses a single or fewer dielectric pieces instead of usual large number of small dielectric pieces as in FIG. 1B and FIG. 1C, which make an apparatus relatively simple in construction and maintenance. An exemplary plasma generating apparatus according to any preceding concepts may force-feed air/water to cool electrodes 405. Plasma may be generated inside an enclosure or in open air. A gas may be flown through a discharge region from pores or holes in electrode(s) and/or dielectric.

An exemplary plasma apparatus may consist of a dielectric with non-uniform thickness of approximately 0.002-20 mm. One or both electrodes may be in a form of a mesh or any other pattern as in FIG. 4E and FIG. 4I. A patterned electrode may be located at a position of higher or lower thickness of a dielectric to control a plasma formation mechanism and region as in FIG. 4E. An exemplary gas to be treated may contain substances including but not limited to liquid aerosols or solid particles. An electrode gap for plasma generation may be approximately between 0.1-50 mm, and it may depend on factors including but not limited to application, pressure, gas, gas flow rate, gas temperature, electrode arrangement and applied voltage/power among others. Plasma may be powered by either a single or combination of power supplies including but not limited to RF, DC, AC, pulsed DC, pulsed RF, kHz, pulsed power supplies to establish a minimum required electric field in a discharge gap. A plasma device may be used to carry out processes including but not limited to gaseous/aerosol pollutant removal, gas conversion, sterilization of articles, surface treatment, surface functionalization, sterilization of air, ozone production, generating nanoparticles, charging particles and their removal, hydrocarbon conversion and oil cracking.

One or more sets of components including but not limited to electrodes, dielectrics, resistors, inductors, capacitors, within a plasma system may be used in series or parallel with an electrode gap to control factors including but not limited to width, decay, and amplitude of the current. An apparatus may generate multiple small discharges at regular positions at low applied voltage and power. A plasma system design may limit as in FIG. 2 or enhance a generation of a ozone as in FIG. 3. A plasma system design may produce nitrogen monoxide with limited ozone and/or nitrogen oxides as in FIG. 2. It may generate uniform discharge over a large area, and it may be used to produce ozone, treat gases, liquid-gas mixtures or liquids, and even surfaces. Preferably, plasma treatment device may generate non-equilibrium plasma using a dielectric barrier plasma (DBD) comprising two electrodes spaced apart where one electrode may be covered by a dielectric with non-uniform regular structure while the other may be uncovered as in FIG. 4A or covered by a smooth dielectric as in FIG. 1A, with a gap for gas passage of approximately 0.01-4 mm. A structured or patterned dielectric may be preferably made as a single piece or multiple pieces or tiles glued together to form a single structure. Coating dielectric on a patterned electrode 405 as in FIG. 4D may also generate a structured or patterned dielectric. A structured or patterned dielectric may contain regular grooved as in FIG. 6 or extruded patterns as in FIG. 1B and FIG. 1C. A plasma device may have two electrodes 405 spaced apart with a fixed distance in as parallel plates or two co-axial cylinders and powered by an AC voltage applied to electrodes. A dielectric may be coated with a catalyst or photocatalyst or their combination. An exemplary plasma treatment device may generate non-equilibrium plasma using a dielectric barrier plasma (DBD) comprising two electrodes 405 spaced apart where both electrode may be covered by a dielectric with non-uniform regular structure, with a constant gap for gas passage which may be approximately 0.01-4 mm, such that it may generate a cavity. A structured or patterned dielectrics may preferably be made as a two piece as in FIG. 4A through FIG. 4C and FIG. 4F through FIG. 4H (one piece covering each electrode) or multiple pieces or tiles glued together to form a single structure as in FIG. 1A and FIG. 4E (covering each electrode). Coating dielectric on patterned electrodes as in FIG. D may also generate structured or patterned dielectrics. A structured or patterned dielectric may contain regular grooved or extruded patterns as in in FIG. 6 or FIG. 1B and FIG. 1C. A plasma device may have two electrodes spaced apart with a fixed distance 415 as parallel plates 405 or two co-axial cylinders 405A 405B, such that two dielectrics may be patterned on a side exposed to plasma and facing each other; and powered by an AC voltage applied to electrodes. One or both dielectrics may be coated with a catalyst or photocatalyst or their combination in FIG. 1A.

In an exemplary system it may be preferable that a plasma system may be operated at an atmospheric pressure in static or flowing air using a kHz power supply, to generate several stable micro discharges over a large area. Operating at low power may cause multiple small filamentary micro discharges at regular locations of a smallest gap for air passage between dielectrics, which may use tiny power (approximately <10 mW/cm$^2$) and produce very low gas temperatures (approximately <25° C.), as in FIG. 2.° C.). Plasma operated at these conditions may be very suitable where low ozone generation may be desired. By design, plasma may be generated like a pulsed discharge (without using a pulsed power supply) and it only switches on for less than approximately 10% of a complete kHz voltage cycle, as in FIG. 2 cycle. Operating at high power again may generate many small discharges at three locations i.e., filamentary micro discharges at regular locations of a smallest gap for air passage between dielectrics, surface discharge over a curved surface of patterned dielectric, micro-discharges at a location of contact points (at regular locations between dielectric structures on a patterned dielectric), as in FIG. 3; similar to a regular packed bed DBD. A role of three mechanisms may be independently affected or completely eliminated by changing a gap between dielectrics, a curvature of dielectric pattern and distance between dielectric structures. At high power (approximately >50 mW/cm$^2$) plasma may be very suitable for an operation in conditions where high ozone or reactive species generation may be desired, as in FIG. 3. Here, intense plasma may be generated at contact points. An optimal gap for a gas passage and plasma generation may be between approximately 0.01-4 mm, and may depend on application, gas temperature, gas, gas flow, electrode arrangement and applied voltage/power among others.

Figure 4A:
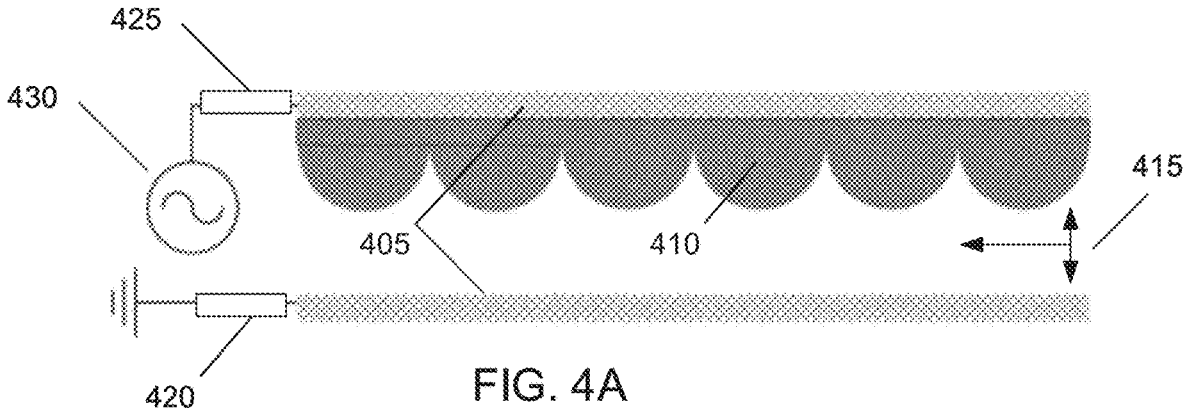
FIG. 4A through FIG. 4I illustrate schematic diagrams of an exemplary plasma source with non-uniform dielectric surface, in accordance with an embodiment of the invention.
Figure 4B:
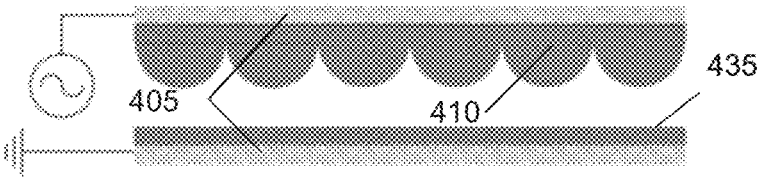
Figure 4C:
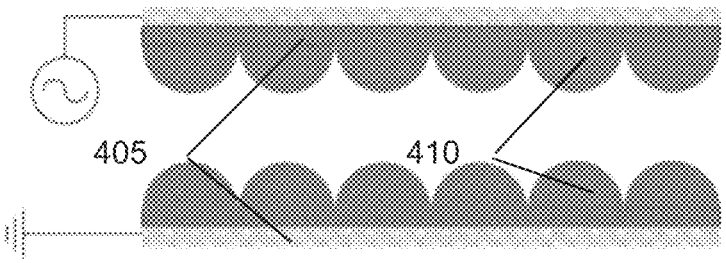
Figure 4D:
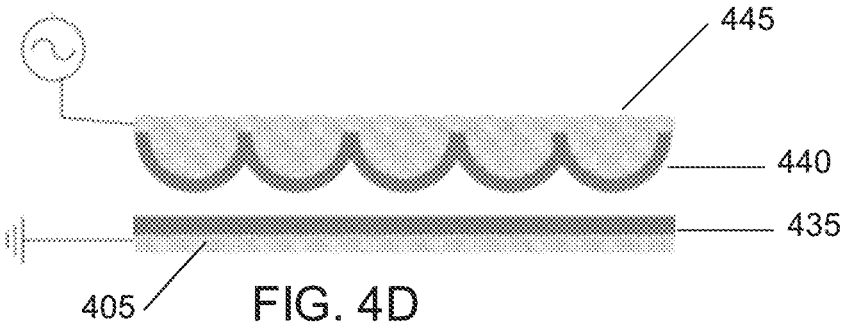
Figure 4E:
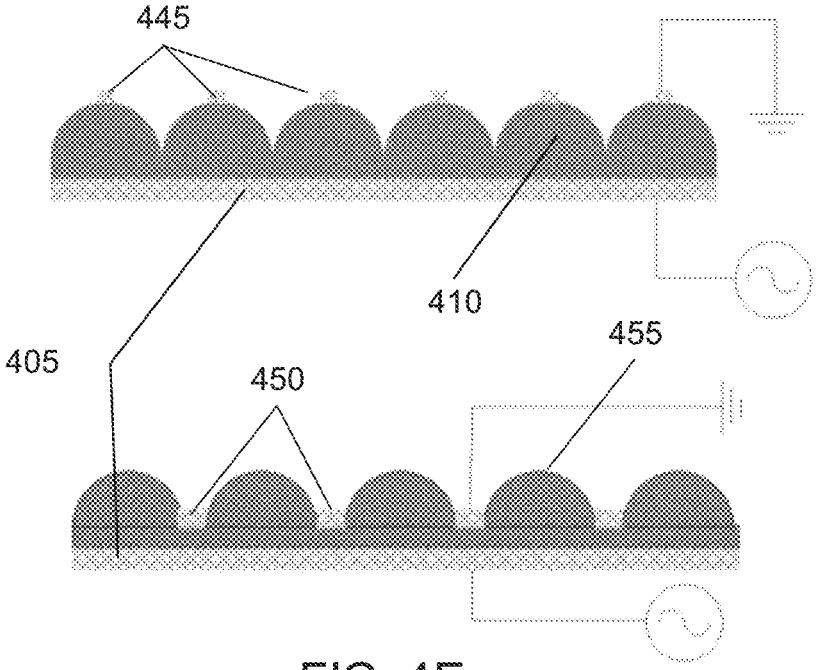

An exemplary plasma treatment device may generate non-equilibrium plasma using a dielectric barrier discharge (DBD) comprising two electrodes spaced apart where one electrode may be covered by a dielectric with non-uniform regular structure while the other may be embedded in an dielectric or lies at a patterned surface of a dielectric as in FIG. 4E, with a distance between electrodes of approximately 0.01-6 mm. An electrode embedded or lying on the patterned surface is either as made as a mesh or series of parallel wires and may follow a pattern of the dielectric. An exemplary structured or patterned dielectric may preferably be made as a single piece or multiple pieces or tiles glued together to form a single structure. Coating dielectric on a patterned electrode may also generate a structured or patterned dielectric. An electrode may be embedded by covering mesh or wires with dielectric coating. A structured or patterned dielectric may contain regular grooved or extruded patterns as in FIG. 1B, FIG. 1C, FIG. 5 and FIG. 6. A plasma device may be as a flat as in FIG. 1A or curved plate, or a cylinder as in FIG. 4F where pattern and plasma generation is either at an inside or outside surface or both surfaces. A plasma is only generated on a patterned dielectric surface and a device is powered by an AC voltage applied to electrodes. A dielectric may be coated with a catalyst or photocatalyst or their combination as in FIG. 1A.

In an exemplary system it may be preferable that a plasma system may be operated at an atmospheric pressure in static or flowing air using a kHz power supply, to generate several stable micro discharges over a large area. Operating at low power may cause multiple micro discharges at regular locations, which may use tiny power (approximately <10 mW/cm$^2$) and produce very low gas temperatures (approximately <25° C.), as in FIG. 2.° C.). Plasma operated at these conditions may be very suitable where low ozone generation may be desired.

Operating at high plasma covers higher surface area of a patterned dielectric surface. Changing a gap between electrodes, a curvature of a dielectric pattern and distance between dielectric structures may control plasma properties, as in FIG. 3 properties. At high power (approximately >50 mW/cm$^2$) plasma may be very suitable for an operation in conditions where high ozone or reactive species generation may be desired. An optimal distance between two electrodes may be approximately 0.01-4 mm and dielectric thickness may be between approximately 0.01-8 mm, and may depend on application, gas temperature, gas, gas flow, electrode arrangement and applied voltage/power among others.

FIG. 1A illustrates the 2D schematic diagram of an exemplary complete plasma system 100 containing one non-uniform spherical/circular shaped corrugated/extruded dielectric surface 115, coated with the catalyst 120, and one plane dielectric surface 130 in accordance with an embodiment of the invention. The two electrodes 110 are attached to the flat sides of the dielectric surface at the top and bottom. The two electrodes 110 are connected to the positive 135 and grounded 140 terminals of a power supply 145. The two electrodes 110 are arranged in a parallel plate arrangement having a gap 125 are covered by a corrugated/extruded sphere/circle shape pattern dielectric 115, which is then coated by a catalyst 120.

Figure 1B:
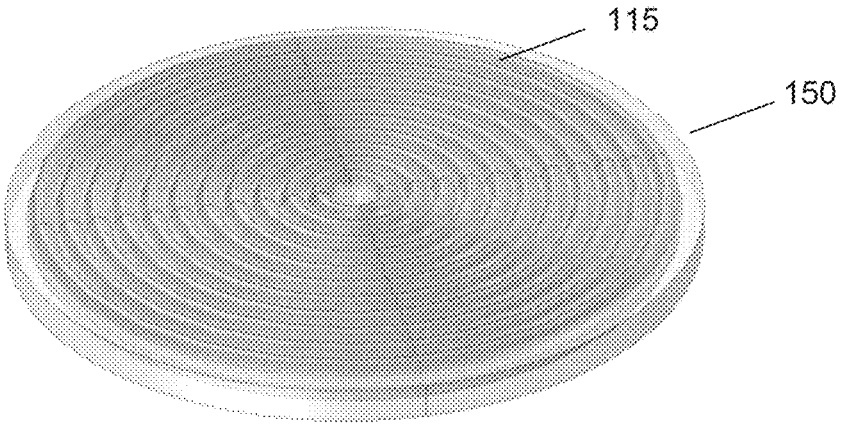
FIG. 1B illustrates a possible 3D schematic of the dielectric plate with a corrugated/extruded sphere/circle shape pattern dielectric, corresponding to FIG. 1A, in accordance with an embodiment of the invention.

FIG. 1B illustrates a possible 3D schematic of the dielectric plate 150 with a corrugated/extruded sphere/circle shape pattern dielectric 115, corresponding to FIG. 1A, in accordance with an embodiment of the invention.

Figure 1C:
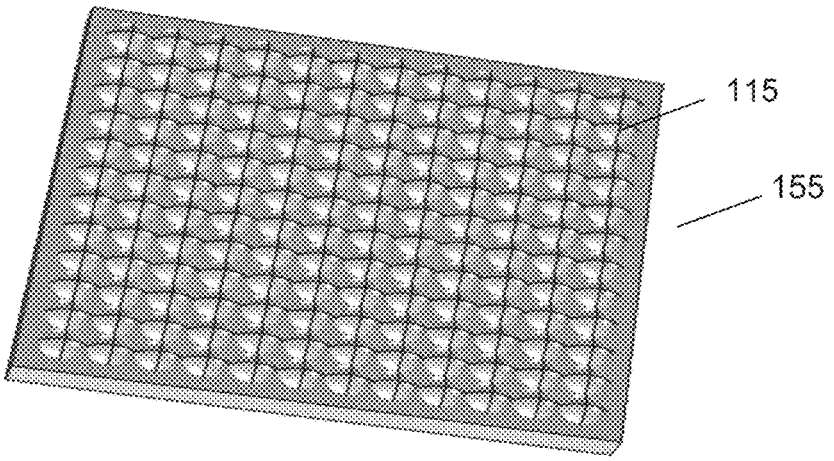
FIG. 1C illustrates a second possible 3D schematic of a non-uniform dielectric surface with a corrugated/extruded sphere/circle shape pattern dielectric, corresponding to FIG. 1A, in accordance with an embodiment of the invention.

FIG. 1C illustrates a second possible 3D schematic of a non-uniform dielectric surface 150 with a corrugated/extruded sphere/circle shape pattern dielectric 115, corresponding to FIG. 1A, in accordance with an embodiment of the invention.

FIG. 2 illustrates a position of an exemplary production of plasma at low power, in accordance with an embodiment of the invention as shown in FIG. 1C. The corresponding 2D schematic in shown in FIG. 1A is used. In this plasma system a dielectric plate with corrugated/extruded sphere/circle shape pattern dielectric 115 similar to FIG. 1C is used.

FIG. 3 illustrates a position of an exemplary production of plasma at high power, in accordance with an embodiment of the invention as shown in FIG. 1A is used. In this plasma system 300 a dielectric plate 115 with corrugated/extruded sphere/circle shape pattern similar to FIG. 1C is used.

In FIGS. 4A through 4I, in an embodiment, a component 405 may be an electrode, and a material 410 may be a dielectric, in accordance with an embodiment of the invention.

FIG. 4A through FIG. 4I illustrate schematic diagrams of an exemplary plasma source variations with non-uniform dielectric surface, in accordance with an embodiment of the invention.

In FIG. 4A only one corrugated/extruded sphere/circle shape patterned dielectric part 410 is present between the electrodes 405 and there is no catalyst coating. The two electrodes 405 are couple to the positive 425 and grounded 420 connector of a power supply 430. The two electrodes 405 are arranged in a parallel plate arrangement having a proximately uniform air gap 415 of a predetermined distance.

In FIG. 4B, only one corrugated/extruded sphere/circle shape patterned dielectric part 410 and one plane dielectric plate 435 is present between the electrodes 405.

In FIG. 4C, two corrugated/extruded sphere/circle shape patterned dielectric parts 410 are present between the electrodes 405. The pattern of both parts can be similar to different. The two dielectric parts 410 may face each other at the location of higher thickness or one at the location of higher thickness and other at the location of lower thickness.

In FIG. 4D, a corrugated/extruded sphere/circle shape patterned electrode 445 similar to the dielectric pattern in FIG. 1B or 1C. The patterned electrode 445 is then coated with a dielectric 440 with a variation of methods, as indicated later.

In FIG. 4E two possible designs of surface barrier discharge are shown, where electrodes 405 445 450 lie on the two sides of the continuous corrugated/grooved spherical/circular patterned dielectric 410 and/or alternating corrugated/grooved spherical/circular patterned dielectric 455. The electrodes 405 445 450 on the flat or patterned side of the dielectric or both may be in the form of mesh or pattern. A mesh electrode 445 may be present at the location of higher dielectric thickness 410. A mesh electrode 450 may be present at the location of lower dielectric thickness 455, in between the alternating corrugated/grooved spherical/circular patterned dielectric 455. The continuous corrugated/grooved spherical/circular patterned dielectric 410 is similar to the dielectric pattern in FIG. 1B. The alternating corrugated/grooved spherical/circular patterned dielectric 445 is similar to the dielectric pattern in FIG. 1C. The electrode 445 450 is then coated with a dielectric 440 as shown in FIG. 4D. The patterned or plane side electrode 445 450 can be further coated with a catalyst 120, as shown in FIG. 1A to embed the electrode 445 450 inside the dielectric.

Figure 4F:
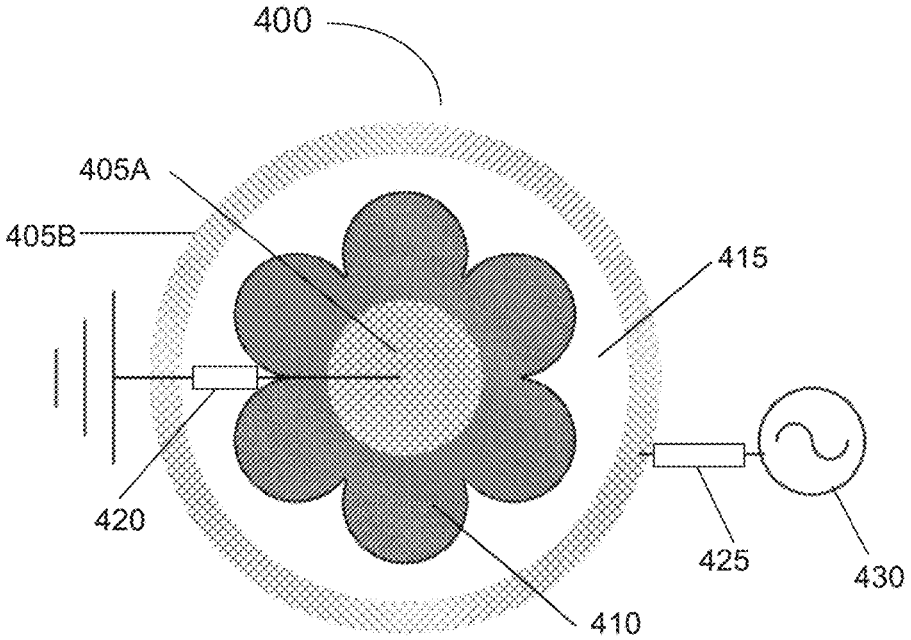

FIG. 4F illustrates the 2D schematic diagram of an exemplary complete plasma system in a coaxial cylinder arrangement 400 containing one corrugated/extruded spherical/circular shaped dielectric 410, in accordance with an embodiment of the invention. The coaxial arrangement here is similar to FIG. 4A where a parallel plate arrangement is used. The two cylindrical coaxial electrodes 405A 405B have a constant gap 415 at all locations. One of the electrodes is covered with a non-uniform shaped extruded dielectric structure. Any combination of design elements from FIG. 4A through FIG. 4I, and FIG. 1A may be used in a coaxial arrangement. The coaxial electrode cylinders may have any radius and length. The electrode cylinders may be complete (360 degrees) as shown here or incomplete (less than 360 degrees).

Figure 4G:
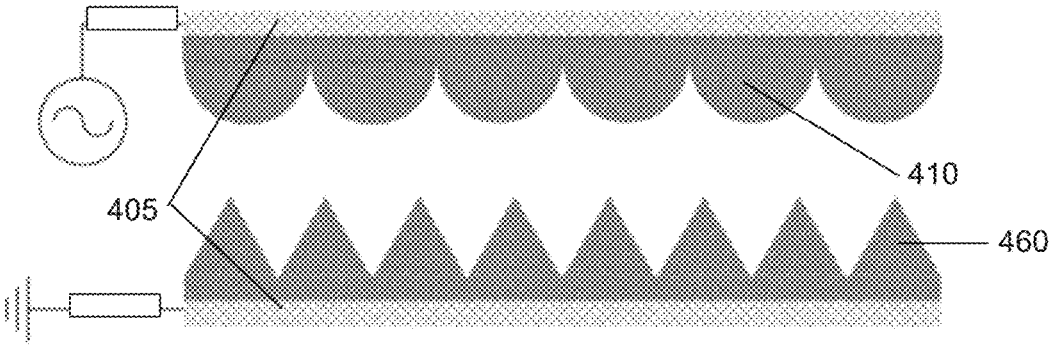

In FIG. 4G, two different corrugated/fluted patterned dielectric parts 410 460 are present between the electrodes 405. The corrugated/fluted pattern of both parts is different. The corrugated/fluted dielectric 410 coupled to the positive terminal 425 of the power supply 430 includes a spherical/circular shape. The corrugated/fluted dielectric 460 coupled to the ground connector 420 of the power supply includes a spherical/circular shape. The two dielectric parts 410 460 may be parallel to each other separated at a predetermined air gap while facing each other.

Figure 4H:
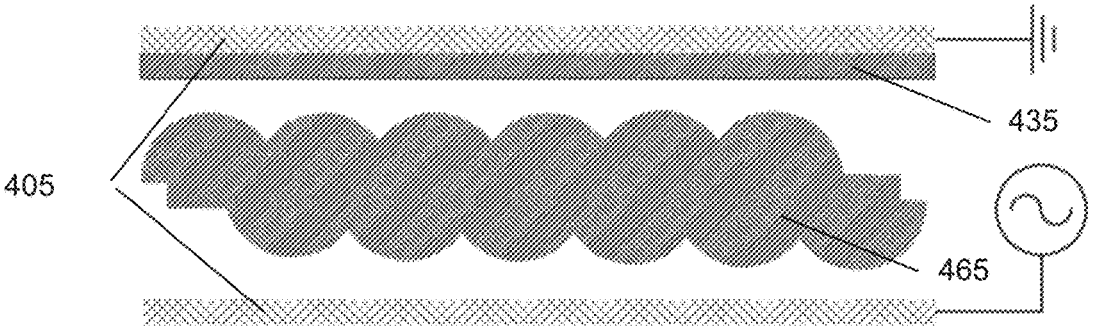

In FIG. 4H, one corrugated/grooved spherical/circular patterned dielectric part 465 is inserted in the space between the electrodes 405 and one plane dielectric plate 435 is covering one of the electrodes 405, is shown.

Figure 4I:
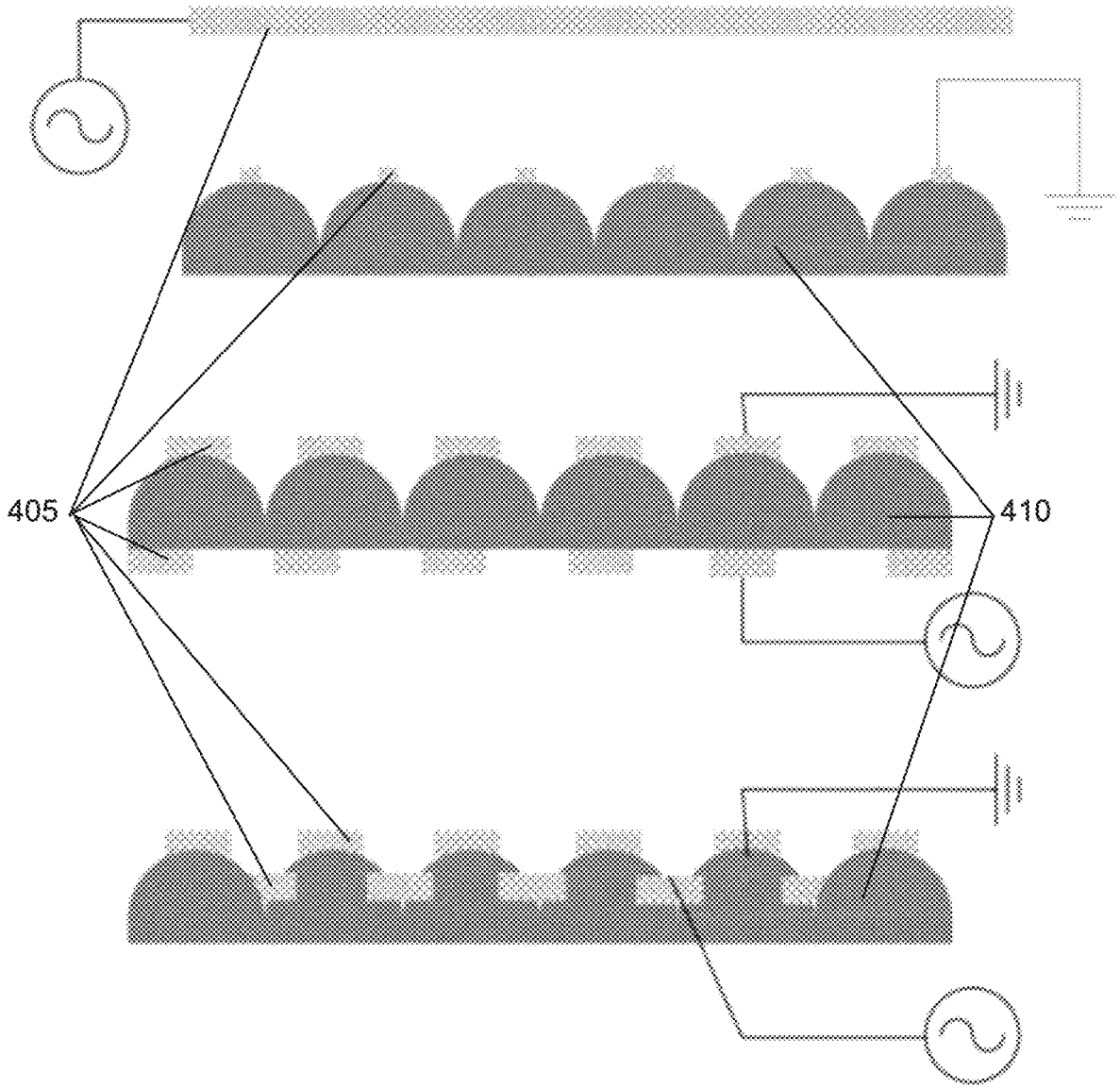

In FIG. 4I a plasma system in accordance with the embodiment of the present invention is shown, where the electrode 405 is present on the patterned side of the dielectric 410.

Figure 4J:
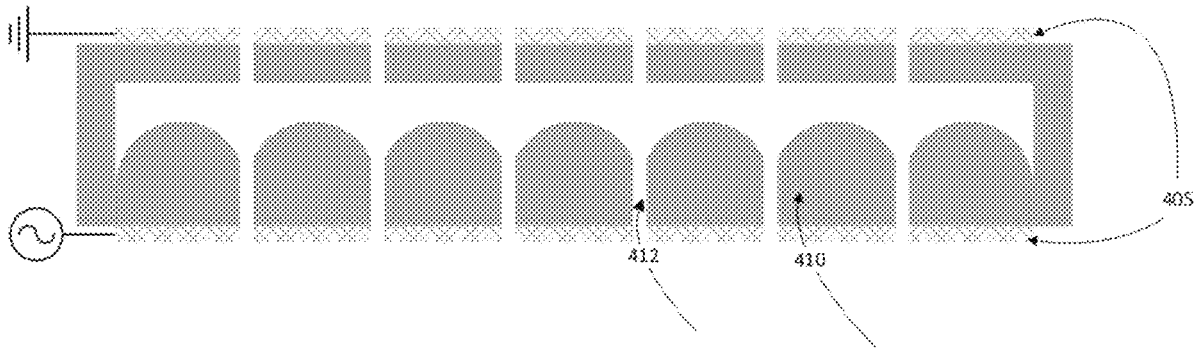
FIG. 4J and FIG. 4K illustrate two alternative design approaches, according to other possible embodiments of the present invention.
Figure 4K:
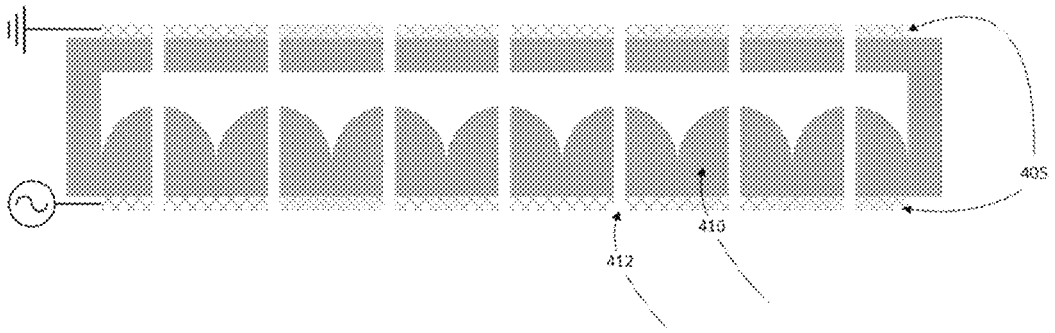

FIG. 4J and FIG. 4K illustrate two alternative design approaches, according to other possible embodiments of the present invention. In which embodiments, there are holes 412 for the passage of gas in the electrodes 405 and dielectrics 410.

Figure 4L:
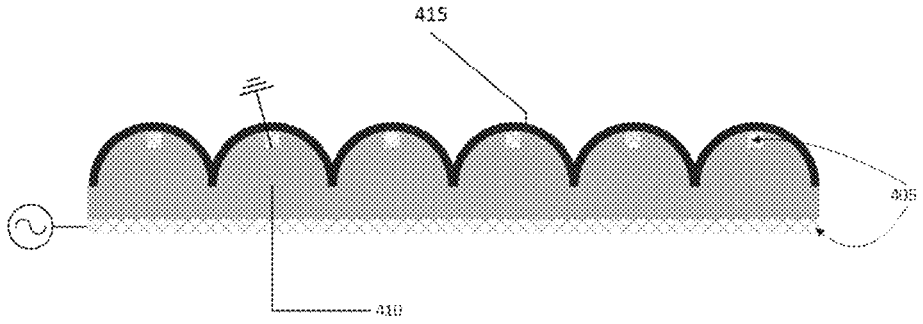
FIG. 4L and FIG. 4M illustrate two other possible design approaches of surface barrier discharge, according to yet other possible embodiments of the present invention.
Figure 4M:
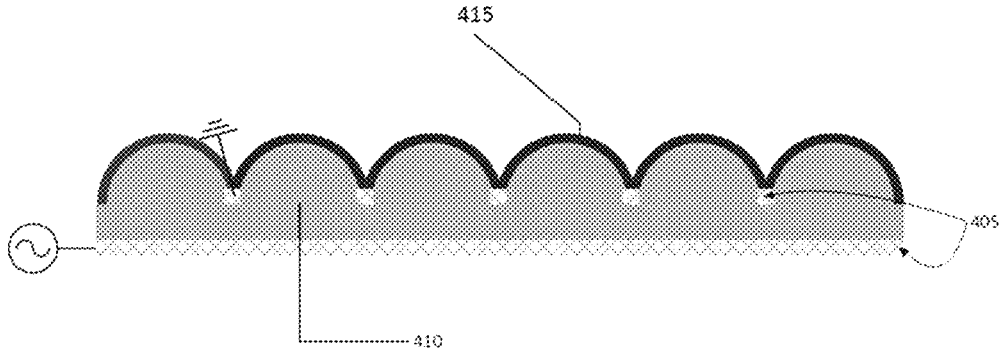
Figure 5:
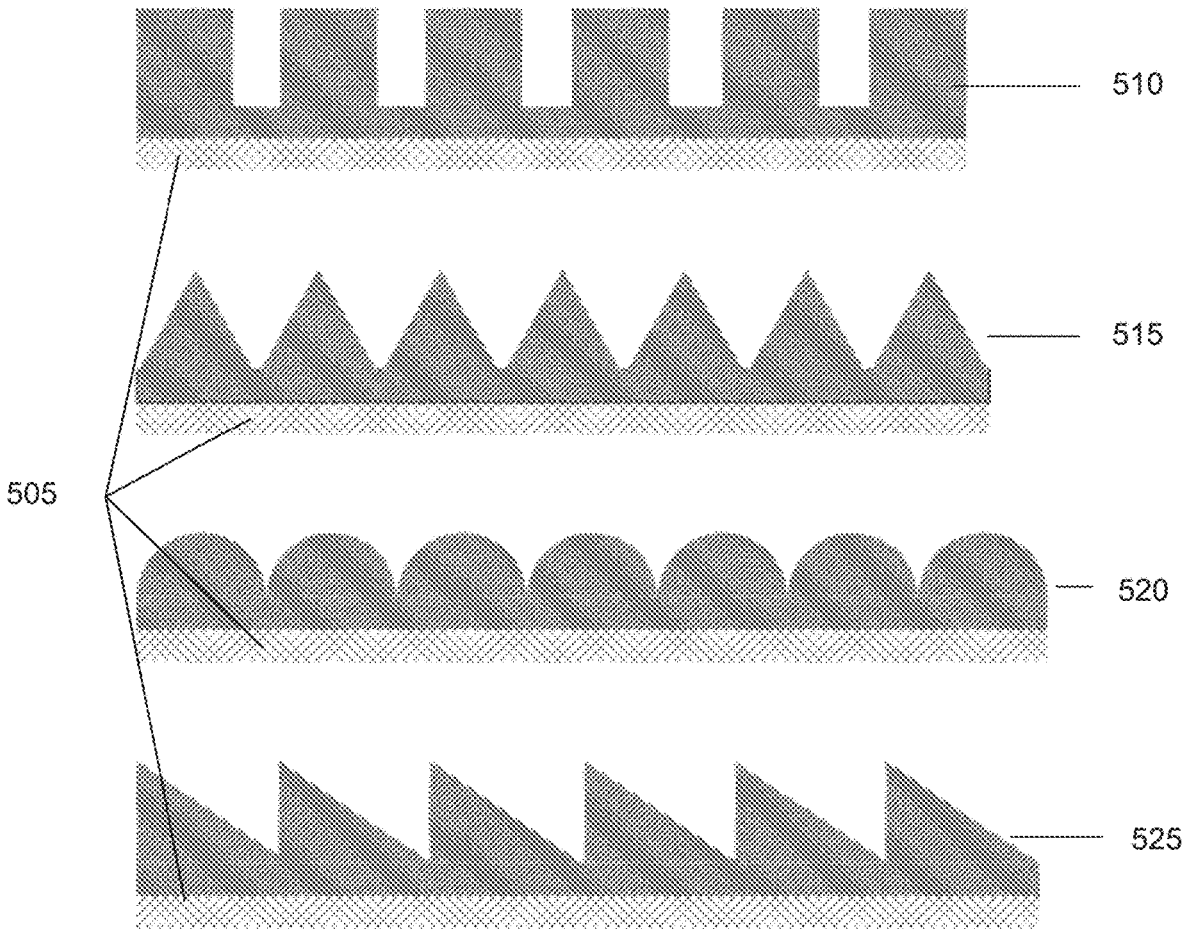
FIG. 5 illustrates a schematic diagram of exemplary dielectric structure, in accordance with an embodiment of the invention.

FIG. 4L and FIG. 4M illustrate two other possible design approaches of surface barrier discharge, according to yet other possible embodiments of the present invention. In which embodiments, both electrodes lie on the two sides of the regularly patterned dielectric and at least one electrode is embedded. The electrode on the flat or patterned side or both may be in the form of mesh or pattern. It may be present at the location of higher dielectric thickness (top) or lower (bottom) dielectric thickness. a regularly extruded patterned electrode similar to the dielectric pattern in FIG. 1B or 1C. The patterned electrode is then coated with a dielectric 415 (indicated by dark grey color) with a variation of methods, as indicated later. The patterned or plane side electrode is coated with dielectric and/catalyst, as shown in FIG. 4D to embed the electrodes 405 inside the dielectric FIG. 5 illustrates a schematic diagram of various exemplary corrugated/extruded dielectric pattern structures, in accordance with an embodiment of the invention. In 2D, the corrugated/extruded structure may be, but not limited to, cones 515, lenses or spheres/circles 520, hemisphere pyramids 525, squares or rectangles 510, their combination or any other known geometrical shape.

In FIG. 5, a component 505 may be an electrode, and a material 510 515 520 525 may be a dielectric, in accordance with an embodiment of the invention.

Figure 6:
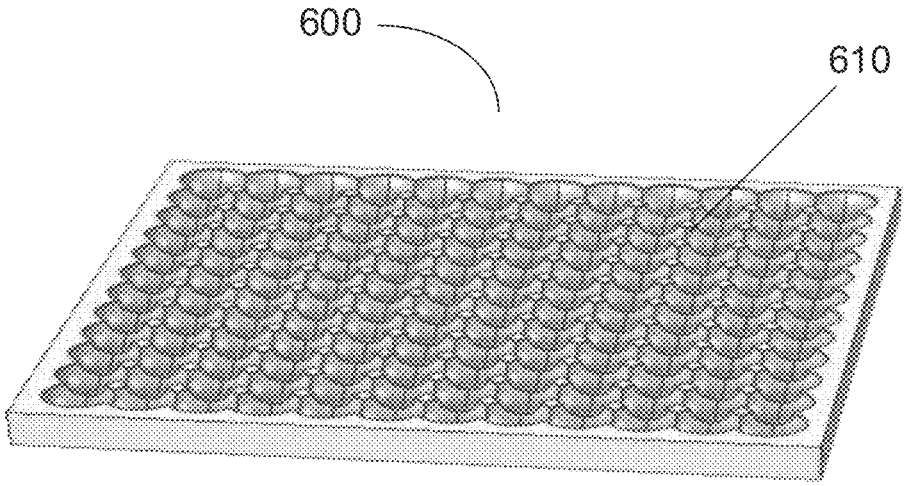
FIG. 6 illustrates a schematic diagram of exemplary dielectric structure, in accordance with an embodiment of the invention.

FIG. 6 illustrates a schematic diagram of exemplary corrugated/fluted/grooved dielectric structure 600 in 3D with hemisphere grooves 610, in accordance with an embodiment of the invention. The grooves may have any shape as shown in extruded structures in FIG. 5. The grooved dielectric plate may be arranged in any arrangement as shown in FIG. 1 through FIG. 4I.

Figure 7:
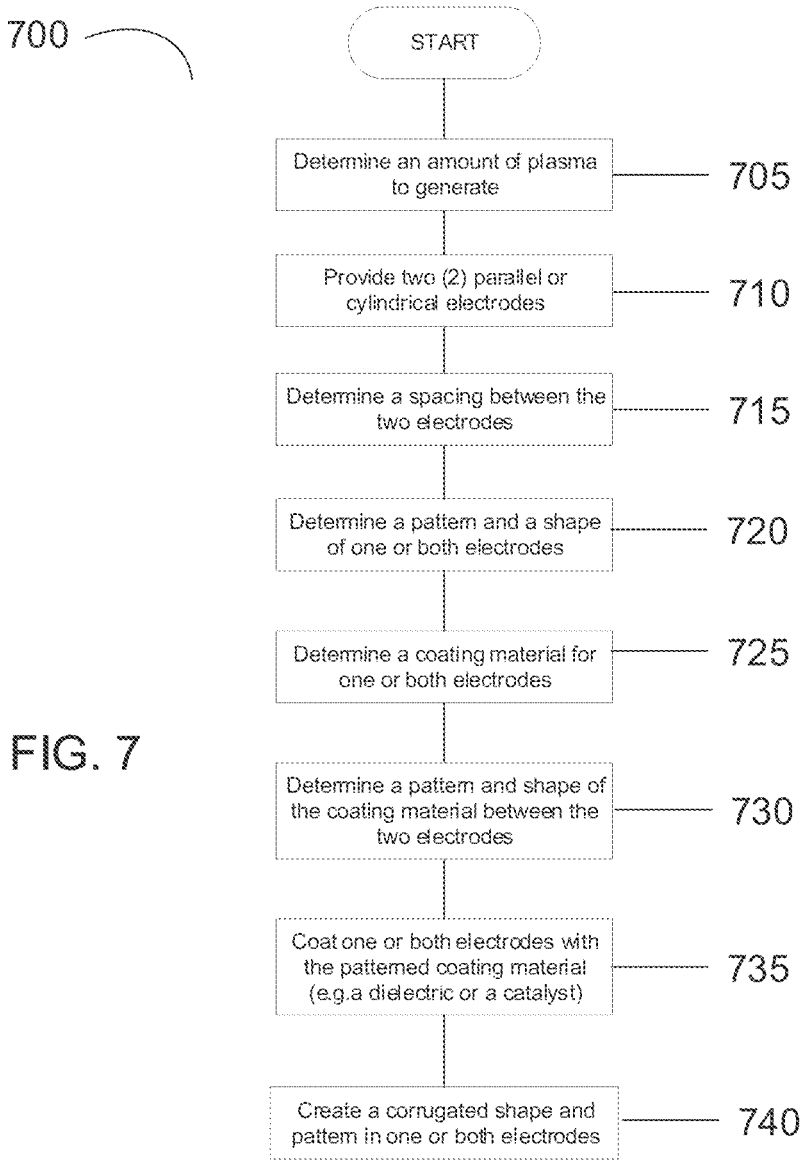
FIG. 7 shows a flowchart illustrating a method of an exemplary production of a plasma generating device, in accordance with an embodiment of the invention.

FIG. 7 shows a flowchart illustrating a method of an exemplary production of a plasma generating device, in accordance with an embodiment of the invention. In a Step 705, determine an amount of plasma to generate. At least some embodiments of the present invention are contemplated to provide an improved plasma device to generate a relatively uniform, stable and reproducible discharge over large areas which may operate at approximately 5-60% lower power than a conventional dielectric barrier discharge (DBD). In another exemplary system it may be preferable that a plasma system may be operated at an atmospheric pressure in static or flowing air using a kHz power supply, to generate several stable micro discharges over a large area. In an alternative exemplary system it may be preferable that a plasma system may be operated at an atmospheric pressure in static or flowing air using a kHz power supply, to generate several stable micro discharges over a large area.

Referring to both FIG. 7 and FIG. 1, the process may begin at a Step 710, where at least two (2) electrodes are provided, which may have various shapes and orientations such as, but not limited to, parallel or cylindrical, wherein the plasma device may be comprised of two electrodes 405 as shown in FIG. 1 and FIG. 4A through FIG. 4I, which may be spaced apart, and may be, without limitation, powered by a DC, or AC (e.g., low frequency in the kHz range or in the RF range), or pulsed voltage applied to the electrodes, and wherein the dielectric 410 is preferably having a non-uniform surface shaping between the two electrodes. The electrodes may be arranged according to any suitable configuration in light of the teachings of the present invention; e.g., without limitation, in a parallel flat plate configuration, as shown in FIG. 1A and FIG. 4A through FIG. 4D, FIG. 4G FIG. 4H, or as a parallel curved plate, or a coaxial arrangement of two cylinders as shown in FIG. 4F where electrodes 405 may be separated by a certain distance (approximately 0.1-50 mm). An exemplary embodiment may provide a dielectric barrier plasma (DBD: Dielectric Barrier Discharge) comprised of at least two electrodes 405 as shown in FIG. 1 and FIG. 4A through FIG. 4I, where one or more non-uniform dielectric 410 may be present inside a plasma production region.

In a Step 715, a gap or spacing between the two electrodes may be determined. Geometrically electrodes may be arranged as two parallel flat or curved plates or two concentric cylinders, separated by a gap or spacing of a few mm through which a gas may be flown. For example, an electrode gap for plasma generation may be approximately between 0.1-50 mm, and it may depend on factors including but not limited to application, pressure, gas, gas flow rate, gas temperature, electrode arrangement and applied voltage/power among others.

In a Step 720, determine a pattern and a shape of one or both electrodes. One or both electrodes may be in a form of a mesh or any other pattern as in FIG. 4E and FIG. 4I. A patterned electrode may be located at a position of higher or lower thickness of a dielectric to control a plasma formation mechanism and region as in FIG. 4E.

In a Step 725, determine a coating material for one or both electrodes. Coating dielectric on a patterned electrode 405 as in FIG. 4D may also generate a structured or patterned dielectric.

In a Step 730, determine a pattern and shape of the coating material between the two electrodes. The invention may use a patterned dielectric 410 as shown in FIG. 1 and FIG. 4A through FIG. 4I, either over one or both electrodes 405 and/or between two electrodes which may produce several small plasmas at regular positions. One or both of the electrodes may be coated on the side exposed to plasma as in FIG. 4D with dielectrics made of a material including but not limited to ceramic (alumina, zirconia, silica, zeolites, BaTiO3 etc.), or glass, or catalyst (metal nanoparticles, metal oxide etc.), or photo-catalyst (TiO2), or their combination.

In a Step 735, coat one or both electrodes with the patterned coating material (e.g. a dielectric or a catalyst). Coating dielectric on patterned electrodes as in FIG. D may also generate structured or patterned dielectrics. FIG. 1A illustrates the 2D schematic diagram of an exemplary complete plasma system 100 containing one non-uniform spherical/circular shaped corrugated/extruded dielectric surface 115, coated with the catalyst 120, and one plane dielectric surface 130 in accordance with an embodiment of the invention.

In a Step 740, a corrugated shape and pattern may be created in one or both electrodes and/or in one or both dielectrics. In some embodiments, the shaping and patterning may be done instead only in one or more of the dielectrics, in others only one or more of the electrodes, or in any combination of one or more of both the electrodes and or dielectrics. Dielectric covering of one or both electrodes may be either roughened or patterned randomly or patterned regularly. A surface of a dielectric plate with a regular pattern may consist comprise of but not limited to multiple extruded, grooved, corrugated, fluted or ribbed shapes including but not limited to spheres (circular), hemispheres, lenses, cones, oval, pyramids, saw tooth, squares, rectangles etc., as in FIG. 1A through FIG. 1C, FIG. 5 and FIG. 6 etc. A structured or patterned dielectric may be made as a single piece or multiple pieces or tiles glued together to form a single structure. A structured or patterned dielectrics may be made as a two piece as in FIG. 4A through FIG. 4C and FIG. 4F through FIG. 4H (one piece covering each electrode) or multiple pieces or tiles glued together to form a single structure as in FIG. 1A and FIG. 4E (covering each electrode).

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing plasma device with patterned dielectric according to the present invention will be apparent to those skilled in the art. Various aspects of the invention have been described above by way of illustration, and the specific embodiments disclosed are not intended to limit the invention to the particular forms disclosed. The particular implementation of the plasma device with patterned dielectric may vary depending upon the particular context or application. By way of example, and not limitation, the plasma device with patterned dielectric described in the foregoing were principally directed to plasma device with patterned dielectric barrier between the electrodes implementations; however, similar techniques may instead be applied to generating plasma in general, generating plasma along with additional or enhancing materials, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising: a first electrode component, in which said first electrode component comprises a first side portion and a second side portion; a second electrode component, in which said second electrode component comprises a proximate front side portion and a proximate back side portion; a plasma producing region; a ground connector component, wherein said ground connector component is into engagement with said second electrode component a first dielectric segment, wherein said first dielectric segment is configured to substantially coat said second side portion of said first electrode component, and at least one of said first and second electrode components and/or first dielectric segment are configured to be protruding shapes which are roughened or patterned randomly or patterned regularly; and an electric power receiver configured to be into engagement with said first electrode component, wherein when electric power is applied to said electric power receiver, said device is operable for substantially converting gas in a proximity of said plasma producing region, into plasma;

and further wherein said first electrode component and said second electrode component are separated by a predetermined distance;

in which said plasma producing region is disposed between said second side portion of said first electrode component and said proximate front side portion of said second electrode component;

in which a surface of said first dielectric segment facing said plasma producing region comprises at least one of: a plurality of extruded shapes, a plurality of grooved shapes, a plurality of corrugated shapes, and a plurality of fluted shapes;

in which said plurality of corrugated shapes comprises at least a plurality of spherical shapes or a plurality of circular shapes glued together to form a single structure;

in which said first dielectric segment further comprises a ceramic or glass material; and in which said first electrode component and said second electrode component comprises at least a coaxial arrangement of two cylinders, and said first dielectric segment comprises at least a cylindrical structure.

2. The device of claim 1, in which said first electrode component and said second electrode component are separated by a distance of approximately 0.1-5.0 mm.

3. The device of claim 2, in which said distance of approximately 0.1-5.0 mm between first electrode component and said second electrode component are generally constant at all location of separation.

4. The device of claim 2, in which said first electrode component and said second electrode component comprises at least one of, a solid material and a mesh material.

5. The device of claim 4, further comprising a second dielectric segment, wherein said second dielectric segment is configured to be operable for coating said proximate front side portion of said second electrode component.

6. The device of claim 5, in which a surface of said second dielectric segment facing said plasma producing region comprises at least one of, a plurality of extruded shapes, a plurality of grooved shapes, a plurality of corrugated shapes, and a plurality of fluted shapes.

7. The device of claim 6, in which said plurality of corrugated shapes comprises at least a plurality of triangular shapes glued together to form a single structure.

8. The device of claim 1, further comprising: means for converting gas into plasma; and means for providing a plurality of protruding shapes glued formed as a single structure.

9. The device of claim 1, in which: said first electrode component and said second electrode component comprises at least one of, a parallel flat plate configuration and a parallel curved plate layout; said first electrode component and said second electrode component are separated by a predetermined distance; said plasma producing region is disposed between said second side portion of said first electrode component and said proximate front side portion of said second electrode component; and, a surface of said first dielectric segment facing said plasma producing region comprises at least a plurality of fluted spherical shapes glued together to form a single structure.

10. The device of claim 9, further comprising a second dielectric segment, wherein said second dielectric segment is configured to be operable for coating said proximate front side portion of said second electrode component, in which a surface of said first dielectric segment facing said plasma producing region comprises at least a plurality of corrugated triangular shapes glued together to form a single structure.

11. A device comprising: a first electrode component, in which said first electrode component comprises a first side portion and a second side portion; a second electrode component, in which said second electrode component comprises a proximate front side portion and a proximate back side portion; a plasma producing region; a ground connector component, wherein said ground connector component is into engagement with said second electrode component a first dielectric segment, wherein said first dielectric segment is configured to substantially coat said second side portion of said first electrode component, and at least one of said first and second electrode components and/or first dielectric segment are configured to be protruding shapes which are roughened or patterned randomly or patterned regularly; and an electric power receiver configured to be into engagement with said first electrode component, wherein when electric power is applied to said electric power receiver, said device is operable for substantially converting gas in a proximity of said plasma producing region, into plasma, further comprising a catalyst, wherein said catalyst is configured to coat said proximate back side portion of said second electrode component.

12. The device of claim 11, in which said first electrode component and said second electrode component are separated by a distance of approximately 0.1-5.0 mm.

13. The device of claim 12, in which said distance of approximately 0.1-5.0 mm between first electrode component and said second electrode component are generally constant at all location of separation.

14. The device of claim 12, in which said first electrode component and said second electrode component comprises at least one of, a solid material and a mesh material.

15. The device of claim 14, further comprising a second dielectric segment, wherein said second dielectric segment is configured to be operable for coating said proximate front side portion of said second electrode component.

16. The device of claim 15, in which a surface of said second dielectric segment facing said plasma producing region comprises at least one of, a plurality of extruded shapes, a plurality of grooved shapes, a plurality of corrugated shapes, and a plurality of fluted shapes.

17. The device of claim 16, in which said plurality of corrugated shapes comprises at least a plurality of triangular shapes glued together to form a single structure.

18. The device of claim 11, further comprising: means for converting gas into plasma; and means for providing a plurality of protruding shapes glued formed as a single structure.

19. The device of claim 11, in which: said first electrode component and said second electrode component comprises at least one of, a parallel flat plate configuration and a parallel curved plate layout; said first electrode component and said second electrode component are separated by a predetermined distance; said plasma producing region is disposed between said second side portion of said first electrode component and said proximate front side portion of said second electrode component; and, a surface of said first dielectric segment facing said plasma producing region comprises at least a plurality of fluted spherical shapes glued together to form a single structure.

20. The device of claim 19, further comprising a second dielectric segment, wherein said second dielectric segment is configured to be operable for coating said proximate front side portion of said second electrode component, in which a surface of said first dielectric segment facing said plasma producing region comprises at least a plurality of corrugated triangular shapes glued together to form a single structure.

* * * * *